United States Patent [19]

Richards et al.

[11] Patent Number: 4,934,529

[45] Date of Patent: Jun. 19, 1990

[54] CASSETTE CONTAINING FLEXIBLE TUBING TO BE DISPENSED THEREFROM

[75] Inventors: David C. Richards, Wokingham; Maurice S. Williams, Cranleigh; Brian Ward, Blackwater, all of United Kingdom

[73] Assignee: Process Improvements Limited, Ascot, United Kingdom

[21] Appl. No.: 384,798

[22] Filed: Jul. 25, 1989

[30] Foreign Application Priority Data

Aug. 2, 1988 [GB] United Kingdom ..... 8818365

[51] Int. Cl.[5] ..... B65D 85/08

[52] U.S. Cl. ..... 206/303; 206/802; 206/69

[58] Field of Search ..... 206/69, 409, 802, 303

[56] References Cited

U.S. PATENT DOCUMENTS

| | | | |
|---|---|---|---|
| 3,452,368 | 7/1969 | Couper | 4/142 |
| 3,536,192 | 10/1970 | Couper | 206/303 |
| 3,928,300 | 2/1976 | Lovqvist | 53/124 E |
| 4,104,774 | 8/1978 | Overmyer et al. | 206/802 |
| 4,132,047 | 1/1979 | Gerigk et al. | 206/802 |
| 4,422,215 | 12/1983 | Wiekens et al. | 206/802 |

FOREIGN PATENT DOCUMENTS

| | | | |
|---|---|---|---|
| 2809585 | 9/1979 | Fed. Rep. of Germany | 206/802 |
| 2853402 | 6/1980 | Fed. Rep. of Germany | 206/802 |
| 2169188 | 7/1986 | United Kingdom . | |

*Primary Examiner*—William Price

*Attorney, Agent, or Firm*—Shoemaker and Mattare, Ltd.

[57] ABSTRACT

In a cassette for dispensing flexible tubing, the tubing is packed in a tightly layered mass between a tubular core and the vertical wall of a casing. Subsequently a cap is mounted in an expanded portion of the casing. The cap has a vertical part fitting the portion and a flange partially overlapping the pack. The cap is secured against rising by punching tongues out of the portion that engage in a groove in the part. The inner surface of part aligns with surface of casing. The junction beneath expanded portion prevents cap from descending as the tubing is dispensed from the top of the pack, over the core edge and through core.

7 Claims, 1 Drawing Sheet

CASSETTE CONTAINING FLEXIBLE TUBING TO BE DISPENSED THEREFROM

FIELD OF THE INVENTION

This invention relates to a cassette containing flexible tubing to be dispensed therefrom. Such a cassette can be located in a position from which the tubing is required and when the tubing is exhausted, the cassette can readily and easily be replaced by a similar full cassette. One situation in which such a cassette can advantageously be used is packaging apparatus as described in applicants' patent application Ser. No. 159,173.

One object of the invention is to provide a cassette that is very well adapted for mass and rapid production by mechanical means and is compact yet capable of containing 100 ft (30.48 m) of tubing, for example.

SUMMARY OF THE INVENTION

According to the invention, a cassette containing flexible substantially non-resilient tubing comprises a rigid body having a central core open at top and bottom and a surrounding casing joined to the lower end of the core by an annular base wall, the tubing being packed profusely in a tightly layered mass between the core and the casing and an annular cap placed over the pack of tubing subsequently to the formation thereof and shaped to extend inwards, from the periphery of the casing towards, but not as far as, the core, detent means operative after mounting the cap being provided on the casing for limiting upward movement of the cap within the casing, the cassette being arranged for the tubing to be dispensed by passing from the top of the pack, between the cap and core, over the top edge of the core and downwards through the core. One advantageous form of detent means comprises tongues bent slightly inwards from the casing wall to engage the periphery of the cap so as to limit upward movement of the cap. Such tongues maybe formed from the casing wall after mounting the cap. Alternatively the tongues maybe formed initially on the casing wall for the cap to snap past them on being mounted.

The cap may be formed with a cylindrical part and a flange that projects over the pack from the top of the cylindrical part and the top of the casing may be expanded to receive the cylindrical part. This arrangement considerably facilitates the assembly of the cassette and its use, when the diameter of the cylindrical part is equal to the diameter of the unexpanded portion of the casing. It is understood that the terms "top" and "bottom" in this specification are simply used to indicate the relative positions of the parts of the cassette, the "top" being the area at which the tubing is discharged from the pack. Obviously the cassette may be mounted in a variety of positions, for example, with its axis horizontal.

DESCRIPTION OF THE DRAWINGS

In order that the invention may be clearly understood and readily carried into effect a cassette for dispensing flexible tubular material will now be described, by way of example, with reference to the accompanying drawings in which.

DESCRIPTION OF PREFERRED EMBODIMENT

Figure 1:
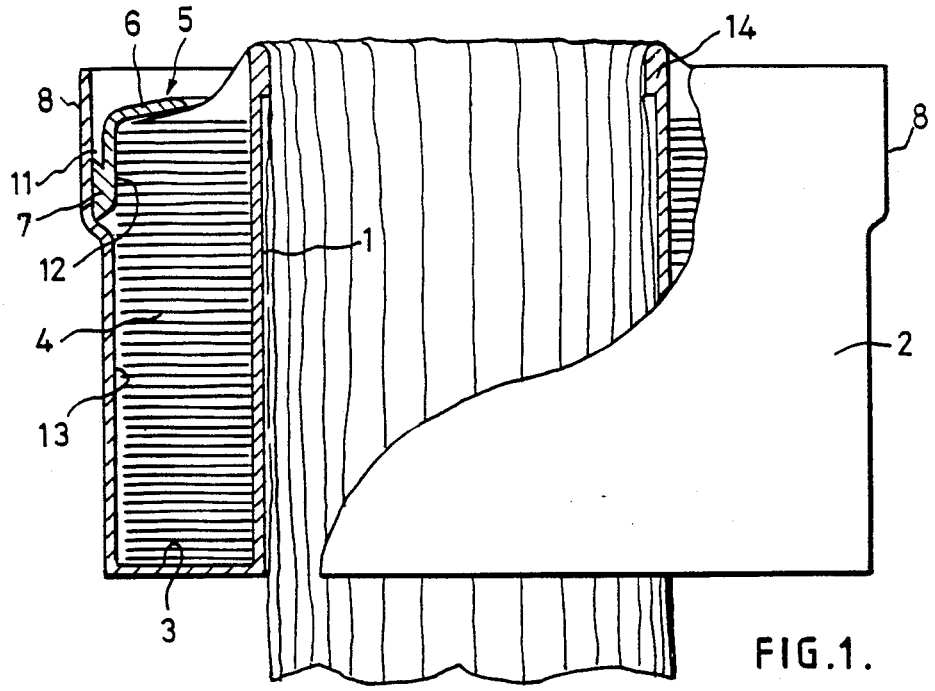
FIG. 1 is a side elevation, partly in section, of the cassette.

Referring to FIG. 1, the body of the cassette consists of a rigid moulding of plastics material comprising a central cylindrical core 1, open at top and bottom and a cylindrical casing 2, open at the top, and having an annular base wall 3 joining the lower ends of the core and casing.

Packed in the cassette between the core and casing is a mass or pack of profusely and tightly layered non-resilient tubing 4, which may for example, be high density polyethylene tubing.

Figure 2:
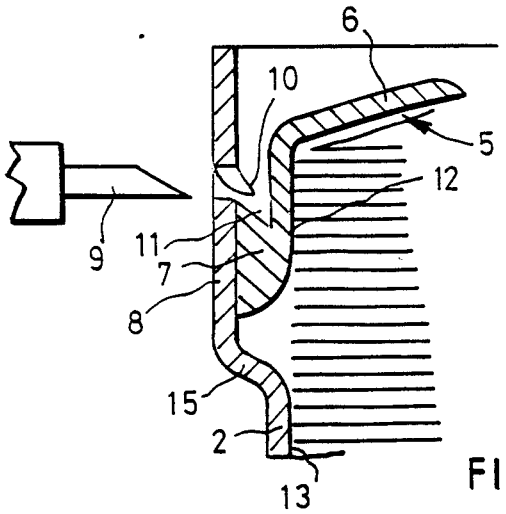
FIG. 2 is an enlargement of part of FIG. 1, showing more detail.
Figure 3:
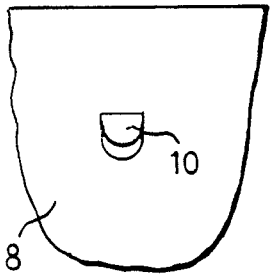
FIG. 3 is a front elevation of part of FIG. 2.

After the tubing has been packed an annular cap 5 is placed over the pack of tubing 4. This cap 5 has a top flange 6 that extends inwards towards, but not as far as, the core 1 from a cylindrical part 7 that has a portion bearing against the inner surface of an expanded portion 8 of the casing 2. To prevent the cap 5 from rising undesirably after it has been mounted, three bevelled piercing tools 9 (FIG. 2) distributed equidistantly round the casing are simultaneously operated to form three tongues 10 bent inwards from portion 8 of the casing to engage in an annular V-shaped groove 11 formed in the cylindrical part 7 of the cap 5. When the cap is mounted, the tubing pack 4 is slightly compressed and then immediately released whereupon the groove 11 is lifted to the tongues 10.

It has proved highly desirable, both from the point of view of the assembly of the cassette and of its use for the inner cylindrical surface 12 of the cylindrical part 7 of the cap to have precisely the same diameter as the inner surface 13 of the unexpanded portion of the casing 2.

In use the cassette is mounted in a support or device such as the packaging device described in patent application Ser. No. 159,173 by the present applicants and the flexible tubing is pulled or pushed (if the end of the tubing is first closed) through the core 1, the tubing passing from the pack 4 between the flange 6 and core 1 and then over the top edge of the core which is slightly expanded at 14 to provide a curved edge to avoid damage to the tubing.

As the flexible tubing is used, the pack shrinks downwards and to prevent the cap 5 from descending and perhaps getting wedged in the casing, the junction 15 at the bottom of the casing expansion 8 acts as a stop.

For tubing of approximately 8 or 9 inches (20 or 23 cm) diameter, the diameter of the core 1 may be approximately 4 inches (10.16 cm). These figures are, of course, only by way of example, and a wide range of sizes is possible.

Various modifications of the cassette described above may be made without departing from the scope of the following claims. For example, in the case of a thermoplastic body dimples may be formed inside the casing (by the external application of hot points) to engage a circumferential groove on the cap. Moreover, it is not essential for the tongues 10 to be formed after the cap 5 has been inserted. They may constitute initial portions of the body prior to filling. Then after the flexible tubing has been packed, the cap is thrust into the body with sufficient force for its edge to snap past the tongues which will then take up positions that prevent the cap from rising in the body. Instead of tongues small dimples or other shallow protuberances or even a shallow embossed ring may be formed on the inside surface of the casing past which the cap is to snap on being mounted.

Apparatus for packing cassettes as described above with layered or pleated flexible tubing is described in GB Patent Application No. 8914064.4.

We claim:

1. A cassette for use in dispensing flexible tubing packed therein in layered form, the cassette comprising a rigid body formed by a central tubular core open at top and bottom, a surrounding casing wall positioned to provide an annular space between said tubular core and said casing wall and an annular base wall joining a lower end of said surrounding casing wall to the lower end of said tubular core, a length of non-resilient flexible tubing packed profusely in a tightly layered mass in said annular space to constitute a pack surrounding said tubular core, a cap placed over said pack of tubing and formed as an annular cap axially movable in said casing and extending radially from said casing wall to a location providing a gap between the inner edge of said cap and said tubular core enabling said tubing to be dispensed by passing from the top of said pack, between said cap and said core, over the top edge of said core and downwards through said core, and detent means integral with said casing wall and projecting inwards therefrom to engage said cap to limit movement of said cap away from said pack.

2. A cassette according to claim 1, in which said detent means are protuberances distributed round the internal surface of said casing wall.

3. A cassette according to claim 2, in which said protuberances are formed on said casing wall subsequently to the mounting of said cap above said pack of tubing.

4. A cassette according to claim 1, in which said casing wall is cylindrical and is formed at its upper end with a cylindrical portion of increased uniform diameter and in which said cap is formed with a cylindrical periphery that is a sliding fit in said cylindrical portion of increased diameter whereby the unexpanded portion of said casing wall limits any downward movement of said cap in said casing wall.

5. A cassette according to claim 4, in which said cylindrical periphery of said cap is formed with an internal peripheral surface of effectively the same diameter as the internal surface of the unexpanded portion of said casing wall.

6. A cassette according to claim 2, in which said protuberances distributed round the internal surface of said casing wall are inwardly projecting tongues and in which said cap is formed with a peripheral surface formed with a groove to be engaged by said tongues.

7. A cassette according to claim 3, in which said protuberances distributed round the internal surface of said casing wall are tongues bent inwards from the casing wall by piercing means.

* * * * *